US007036163B2

(12) United States Patent
Schmid

(10) Patent No.: US 7,036,163 B2
(45) Date of Patent: May 2, 2006

(54) FURNITURE COVER SHEET

(75) Inventor: William Schmid, Plymouth, MN (US)

(73) Assignee: Halo Innovations, Inc., Plymouth, MN (US)

( * ) Notice: Subject to any disclaimer, the term of this patent is extended or adjusted under 35 U.S.C. 154(b) by 0 days.

(21) Appl. No.: 10/360,308

(22) Filed: Feb. 6, 2003

(65) Prior Publication Data

US 2003/0145380 A1 Aug. 7, 2003

Related U.S. Application Data

(60) Provisional application No. 60/354,653, filed on Feb. 6, 2002.

(51) Int. Cl.
*A61H 7/00* (2006.01)

(52) U.S. Cl. ..... 5/423; 421/941

(58) Field of Classification Search ..... 297/180.11; 5/421, 423, 724, 652.1, 941, 497
See application file for complete search history.

(56) References Cited

U.S. PATENT DOCUMENTS

| | | | | |
|---|---|---|---|---|
| 1,142,876 | A | 6/1915 | Davis et al. | |
| 2,025,659 | A | 12/1935 | Gilquin | |
| 2,512,559 | A | 6/1950 | Williams | |
| 2,917,046 | A | 12/1959 | Fairbanks | |
| 3,644,950 | A | 2/1972 | Lindsay, Jr. | |
| 3,681,797 | A * | 8/1972 | Messner | 297/180.13 |
| 4,267,611 | A * | 5/1981 | Agulnick | 5/713 |
| 4,391,009 | A | 7/1983 | Schild et al. | |
| 4,653,130 | A | 3/1987 | Senoue et al. | |
| 4,660,388 | A | 4/1987 | Greene, Jr. | |
| 4,777,802 | A * | 10/1988 | Feher | 62/3.3 |
| 4,867,230 | A * | 9/1989 | Voss | 165/46 |
| 4,898,164 | A | 2/1990 | Baumberg | |
| 4,969,869 | A | 11/1990 | Burgin et al. | |
| 5,023,973 | A * | 6/1991 | Tsuchida et al. | 15/319 |
| 5,125,238 | A | 6/1992 | Ragan et al. | |
| 5,165,400 | A | 11/1992 | Berke | |
| 5,216,770 | A | 6/1993 | Holt | |
| 5,305,483 | A | 4/1994 | Watkins | |
| 5,317,767 | A | 6/1994 | Hargest et al. | |
| 5,389,037 | A | 2/1995 | Hale | |

(Continued)

FOREIGN PATENT DOCUMENTS

| | | |
|---|---|---|
| EP | 0 491 145 | 6/1992 |

(Continued)

OTHER PUBLICATIONS

Bair Hugger® Temperature Management, www.bairhugger.com/arizanthealthcare.faw.shtml.

*Primary Examiner*—Suzanne Dino Barrett
*Assistant Examiner*—Fredrick Conley
(74) *Attorney, Agent, or Firm*—Hamre, Schumann, Mueller & Larson, P.C.

(57) ABSTRACT

A sheet of pliable, washable material is configured to cover at least a portion of a piece of furniture, such as a mattress. A manifold and a plurality of air flow tubes are formed in the sheet, with the air flow tubes in communication with the manifold. The air flow tubes include top surfaces that are constructed to release air at a controlled rate therethrough. The sheet helps reduce exposure to allergens and other harmful particles, including the house dust mite.

12 Claims, 2 Drawing Sheets

U.S. PATENT DOCUMENTS

| | | | | |
|---|---|---|---|---|
| 5,473,783 | A * | 12/1995 | Allen | 5/652.2 |
| 5,590,428 | A | 1/1997 | Roter | |
| 5,640,728 | A | 6/1997 | Graebe | |
| 5,887,304 | A | 3/1999 | von der Heyde | |
| 5,926,884 | A | 7/1999 | Biggie et al. | |
| 6,052,853 | A | 4/2000 | Schmid | |
| 6,085,369 | A | 7/2000 | Feher | |
| 6,171,333 | B1 | 1/2001 | Nelson et al. | |
| 6,189,967 | B1 | 2/2001 | Short | |
| 6,263,530 | B1 * | 7/2001 | Feher | 5/423 |
| 6,334,228 | B1 | 1/2002 | Schmid | |
| 6,425,527 | B1 * | 7/2002 | Smole | 236/49.3 |
| 6,493,889 | B1 * | 12/2002 | Kocurek | 5/423 |

FOREIGN PATENT DOCUMENTS

| | | |
|---|---|---|
| WO | WO 88/04548 | 6/1988 |
| WO | WO 01/84982 | 11/2001 |

* cited by examiner

FURNITURE COVER SHEET

PRIOR APPLICATION

This application claims the benefit of U.S. Provisional Application No. 60/354,653, filed Feb. 6, 2002.

FIELD OF THE INVENTION

This invention relates to furniture covers. More particularly, this invention relates to a furniture cover sheet that is designed with air channels to which can be delivered a variety of air flows that are beneficial, such as improving air quality adjacent the cover and reducing exposure to allergens, to an individual's personal breathing environment. The furniture cover sheet can be used on numerous furniture items, including bed mattresses, chairs, sofas, and other furniture items upon which individuals lay or sit.

BACKGROUND OF THE INVENTION

Asthma in the U.S. and around the world has increased at an alarming rate over the last 20 years and currently affects more than 15 million Americans. There is some speculation as to the cause of this increase, whether due to more time spent indoors in "tighter" homes with less fresh air or because of improvements in early diagnosis of disease. A recent study concluded that the risk due to residential allergen and pollutant exposure accounted for 39% of doctor-diagnosed asthma in U.S. children less than 6 years old. 5,000,000 U.S. children (1 in 13) now suffer from asthma, accounting for 17% of all pediatric emergency room visits.

Allergic rhinitis or hay fever affects 40 million Americans. It can lead to rhinosinusitis (in 14% of the U.S. population) as well as otitis media (e.g. ear ache), the most common childhood disease requiring a healthcare visit.

In addition to the tremendous discomfort associated with these diseases and their all too often tragic outcomes (there are more than 5,000 asthma related deaths per year in the U.S.), the estimated annual cost of asthma in the U.S. is projected to be $14.5 billion this year, up from $6.2 billion only 10 years ago.

The first line of defense against these disease's symptoms recommended by allergists is to reduce environmental exposure. This can be accomplished by removing the allergen source (for example cats, cigarettes, molds, etc.), its reservoir (for example carpets, drapes, etc.) and also by cleaning the air through the use of high-efficiency air cleaners.

Existing air cleaner technology can be very effective at removing a high percentage of particles in the air stream passing through them by means of High Efficiency Particulate Air (HEPA) filters, electrostatic precipitators, etc.

The efficacy of these filters on the particle levels people actually breath, however, is directly dependent on the filter's efficiency, air changes per hour or airflow, and dynamics of the environment such as open doors or windows, forced air ventilation and particle sources within the room. Studies show that these variables, through mixing, can decrease a HEPA (typically 99.97% efficient) filters' effect on room particle counts to an average efficiency of 50% or less where the rooms' occupants are breathing.

As an example, people often utilize room air cleaner units in an attempt to achieve a reduction in particles levels within a localized area. These types of units effectively remove a high percentage of harmful particles from the air that flows through the unit. However, individuals within the area of the unit may not experience all of the beneficial results of this particle removal because the air that is discharged from the unit is able to pick up additional harmful particles from the surrounding environment prior to reaching and being breathed in by the individuals.

SUMMARY OF THE INVENTION

The invention provides a means to significantly improve the air quality in a personal breathing environment. Air quality is improved by one or more of the following: removing allergens and other harmful particles from an air stream prior to the air stream reaching the personal breathing environment; preventing allergens and other harmful particles from reaching the personal breathing environment; and conditioning the air in the personal breathing environment. In one specific implementation, the invention can be used to reduce exposure to a serious allergen producer, the house dust mite (*Dermatophagoides fariae*).

In one aspect of the invention, a sheet of pliable, washable material is configured to cover at least a portion of a piece of furniture. A manifold and a plurality of air flow tubes are formed in the sheet, with the air flow tubes in communication with the manifold. The air flow tubes include top surfaces that are constructed to release air at a controlled rate therethrough. As a result, purified air that is introduced into the manifold flows into the air flow tubes which release air at a controlled rate through their top surfaces.

By suitably selecting the locations of the air flow tubes, the purified air can be delivered directly to the personal breathing environment or zone of an occupant of the furniture upon which the cover is disposed. As a result, there is less mixing of the purified air with non-purified air, so that the air breathed by the individual is of better quality. Further, the delivery of the purified air may be sufficient to create a purified air curtain or zone around the occupant, which prevents allergens and other particles from mixing with the delivered purified air.

Purified air is preferably delivered from an air delivery unit that is connectable to the sheet to deliver purified air to the manifold. The air delivery unit includes a high efficiency filtration mechanism for purifying the air prior to delivery to the sheet. The sheet preferably includes a port to which the air delivery unit connects for feeding air to the manifold.

It is possible to see a 20–80% improvement in air quality within the personal breathing zone, depending on the configuration of the air flow tubes in the sheet.

In one embodiment, the sheet comprises a bedding sheet, preferably a fitted sheet, for a mattress. The sheet is made of soft, bedding-quality fabrics so that the air flow tubes are flexible and self-inflating. This is important so as to not adversely affect the comfort of the mattress and, conversely, make the sleeping surface potentially more comfortable. The manifold is defined by pliable or semi-pliable structure incorporated into the sheet.

The air entering this air-delivery bedding sheet can also be conditioned, for example by heating or cooling the air, humidifying the air, introducing aromas and medicines into the air, and the like. In one instance, heating the air will reduce the relative humidity of the bedding creating a less favorable environment for dust mites which require 50% relative humidity or more to survive.

In yet another instance, a "mite kill" cycle could be initiated when the bed's occupant gets up during which the bedding temperature is to be elevated to a temperature lethal to mites in a relatively short period of time, preventing them from generating allergen material.

When used on a mattress, the sheet could cover select portions or the entire upper surface of the mattress. Moreover, the size of the sheet will be chosen based upon the size of the mattress (e.g. single, twin, queen, king). The sheet could be divided into different zones (e.g. right and left), with each zone including its own air flow tubes and/or manifold. The zones could be fed by the same or different air delivery unit. The use of different air delivery units would accommodate individual temperature preferences.

Moreover, the bedding sheet can be constructed to be fed separate air flows, either from the same or different air delivery unit, at the foot and head of an individual to control the temperature differently near the persons feet and torso to optimize comfort. Different fabrics or air flow tube configurations could be used to adjust airflows in these regions.

A pillowcase utilizing this distribution technology could also be used to augment the bedding sheet airflow.

The bedding sheet could also be designed with certain tubes that have more or less airflow through them or varying porosities to enhance air flow. Certain tubes could have a different tube geometry, such as a higher perimeter profile, to optimize airflow in a given configuration.

The air delivery unit can also be designed to enable a user to use the air delivery unit as a portable room air cleaner when it is not being used to deliver air to the bedding sheet.

These and various other advantages and features of novelty which characterize the invention are pointed out with particularity in the claims annexed hereto and forming a part hereof. However, for a better understanding of the invention, its advantages and objects obtained by its use, reference should be made to the drawings which form a further part hereof, and to the accompanying description, in which there is described a preferred embodiment of the invention.

DETAILED DESCRIPTION OF THE PREFERRED EMBODIMENTS

Figures 1, 2, 3:
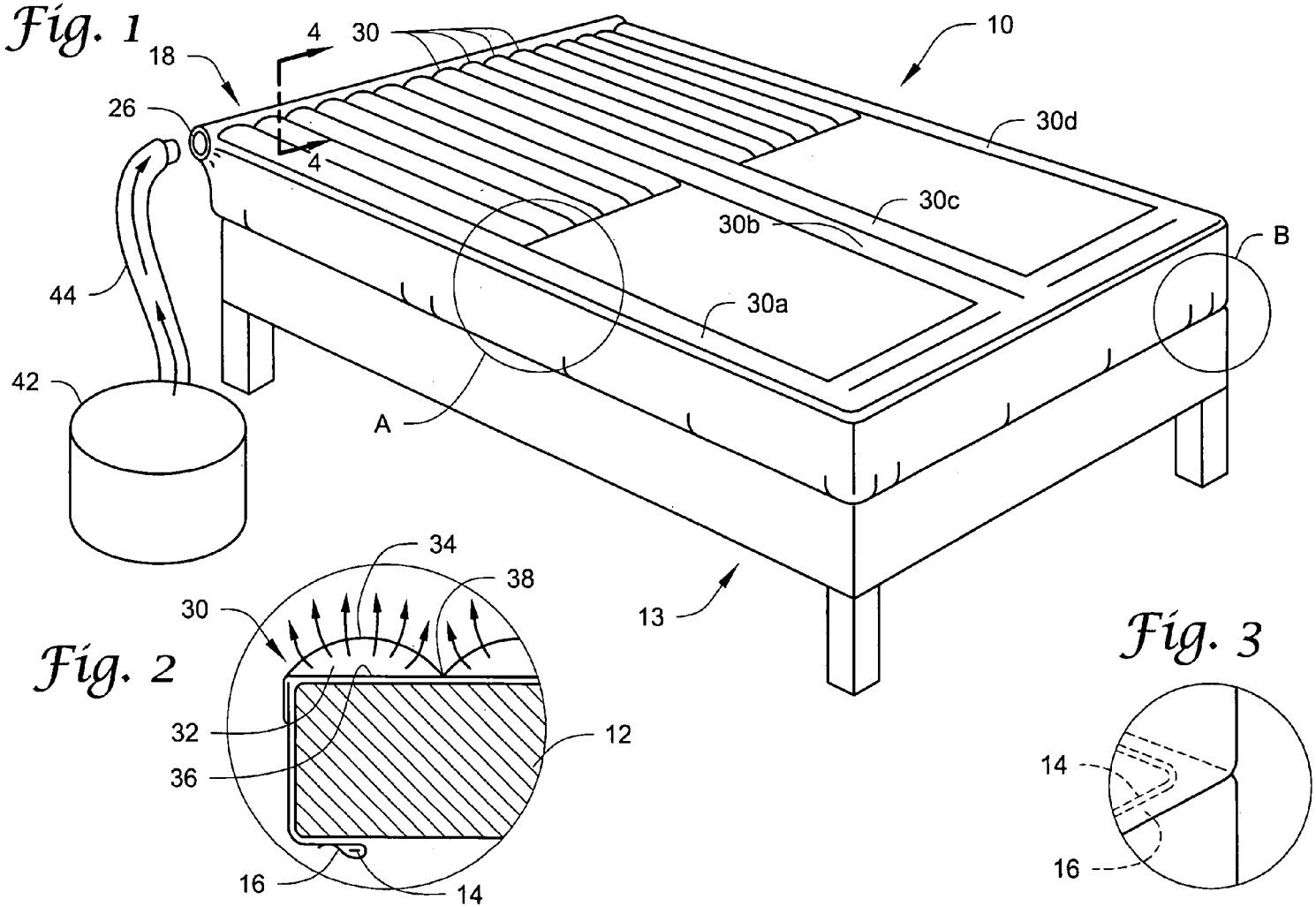
FIG. 1 is a perspective view of a bedding sheet and air delivery unit according to the principles of the present invention.
FIG. 2 is an exploded view of the portion contained within circle A in FIG. 1.
FIG. 3 is an exploded view of the portion containing within circle B in FIG. 1.

The present invention provides a sheet that is intended to cover at least a portion of a piece of furniture, and which is designed to significantly improve the air quality in a personal breathing environment of a person sitting, laying or otherwise occupying the piece of furniture. The term furniture used herein includes bed mattresses, chairs, sofas, and other furniture items.

The preferred embodiment will be described in relation to a bedding sheet for a mattress, illustrated in FIGS. 1–5. However, it is to be realized that the inventive concepts described herein are applicable to other furniture items as well.

Turning now to FIGS. 1–4, a sheet 10 according to invention is illustrated. The sheet 10 is designed to fit over a mattress 12 of a bed 13, similar to conventional bedding sheets. Preferably, the sheet 10 is a fitted sheet having an elastic retainer 14 at a skirt portion 16, as in conventional bedding sheets, allowing the skirt portion of the sheet 10 to be tucked underneath the mattress 12 for securing the sheet 10 to the mattress. The sheet 10 could also be a non-fitted sheet, in which edges of the sheet overhang the mattress 12 a sufficient extent to allow the edges to be tucked underneath the mattress 12. The sheet 10 is illustrated as being directly disposed on the mattress 12. However, the sheet 10 could be disposed over one or more intervening sheets provided on the mattress 12, without changing the concepts described herein.

The size of the sheet 10 is determined by the size of the mattress 12 with which it is to be used. Thus, for a twin size mattress, the sheet 10 is preferably twin sized; for a queen size mattress, the sheet 10 is preferably queen sized; for a king size mattress, the sheet is preferably king sized; etc. Regardless of the mattress size, in the preferred embodiment, the sheet 10 is designed to cover the entire upper surface of the mattress 12. However, it is to be realized that the sheet 10 could be sized so as to cover only select portions of the mattress.

The sheet 10 is preferably made from materials that are used in conventional bedding sheets, for example cotton and cotton/polyester blends. The sheet 10 is pliable to conform to the mattress shape. Further, the sheet 10 is preferably washable like conventional bedding sheets to allow the sheet 10 to be periodically cleaned.

Figure 4:
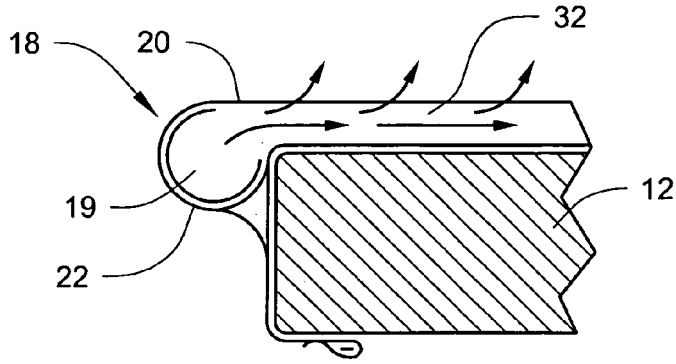
FIG. 4 is a cross-sectional view of the manifold of the bedding sheet taken along line 4—4 of FIG. 1.

As shown in FIG. 1, the sheet 10 is formed with a manifold 18 at the end of the sheet 10 that corresponds to the head of the bed 13. The manifold 18, as best seen in FIG. 4, comprises an air flow passage 19 that is formed between upper and lower layers 20, 22 of the material forming the sheet 10. The air flow passage 19 of the manifold 18 is illustrated as being generally circular, although other shapes, for example rectangular or triangular, could be used as well.

As shown in FIG. 1, an inlet port 26 formed in the sheet 10 allows air to be communicated to the manifold 18. The port 26 is provided at the end of the manifold 18. However, it is possible for the port to be formed at any location along the length of the manifold 18. In addition, more than one port could be provided.

The manifold 18 is constructed so that it will generally maintain its shape when air is flowing therethrough and prevent inadvertent blockage of the manifold from a person resting on the bed 13. However, the manifold 18 must not be so rigid so as to detract from the comfort of the sheet 10. In addition, the manifold 18 should also be capable of withstanding repeated washings of the sheet 10. One way of achieving these goals is to utilize a rigid (or semi-rigid) tube or other structure which would be inserted into the manifold during use, but removed when the sheet is to be laundered. However, other means could be used to maintain the manifold shape. Regardless of the structure used to maintain the manifold shape, the manifold 18 is preferably designed so that air is able to flow out of the upper layer 20. For example, the structure could be completely porous or be formed with apertures or be a wire frame.

The location of the manifold 18 also helps to maintain its shape. The manifold 18 is illustrated as being located at the end of the sheet 10, and during use (as shown in FIG. 1) is preferably positioned along the side edge of the mattress 12 to minimize the likelihood that pillows and persons disposed on top of the bed 13 can collapse the manifold 18 and cause blockage of air flow. The manifold can be located in other positions as well. For example, a manifold could be provided at the end of the sheet 10 opposite the manifold 18 and/or one or more manifolds could be provided along one or more sides of the sheet 10, below the top surface of the mattress.

Figure 5:
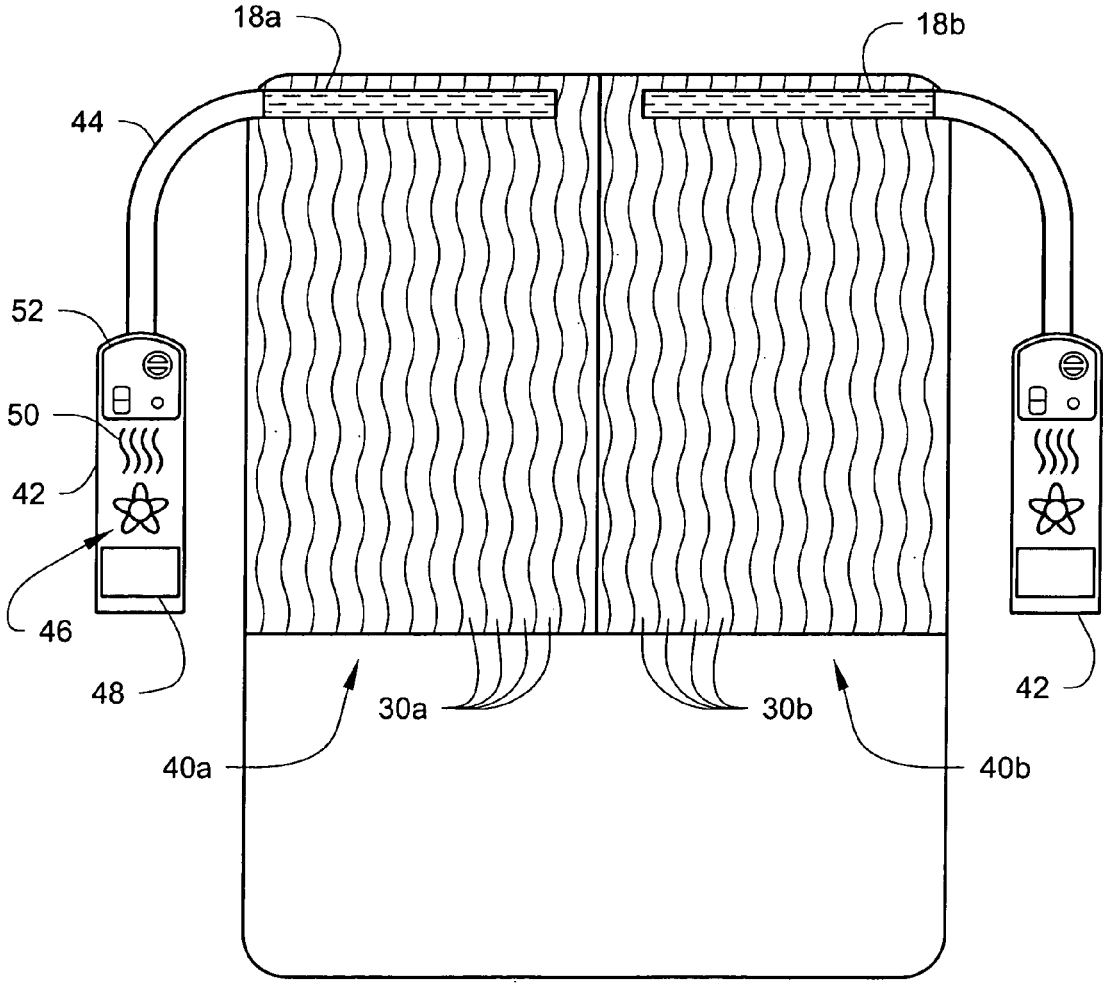
FIG. 5 is a top view of an alternate embodiment of a bedding sheet according to the invention.

The manifold 18 is illustrated as extending along the entire width of the sheet 10 from one side of the bed 13 to the opposite side. However, the manifold 18 could extend along only a portion of the width of the bed, depending upon the area of the sheet 10 that is to be provided air flow. Further, more than one manifold could be used. For example, as shown in FIG. 5, two separate manifolds 18*a*, 18*b* could be provided, which are each provided with their own air flow for feeding the air flows to separate regions of the sheet.

Returning to FIG. 1, a plurality of air flow tubes 30 are also formed in the sheet 10. The air flow tubes 30 preferably extend from adjacent the manifold 18 toward the opposite end of the sheet 10. The air flow tubes 30, as best seen in FIG. 2, comprise air flow passages 32 formed, in part, by the upper and lower layers 34, 36 of the material forming the sheet 10. The upper and lower layers 34, 36 are preferably the same as the upper and lower layers 20, 22 defining the air flow passage 19 of the manifold 18. However, the layers 34, 36 could be made of material that is different than the material forming the layers 20, 22. The air flow passages 32 are separated from one another by sewn seams 38 that connect the layers 34, 36. The seams 38 are preferably non-porous so that the air flow in each passage 32 is separate from the air flow in adjacent passages 32.

As illustrated in FIG. 4, the air flow passages 32 of the tubes 30 are in communication with the air flow passage 19 of the manifold 18. As a result, air introduced into the manifold 18 flows into the tubes 30. The tubes 30 are constructed so that they release air at a controlled rate through their top surfaces. Therefore, air flowing into the tubes 30 is released through the top of the tubes 30 to the environment above the surface of the sheet 10, as shown by the arrows in FIG. 2.

To accomplish the air release from the tubes 30, the upper layer 34 is preferably made from a porous material. The porosity of the upper layer 34 is preferably selected so that a predetermined air release rate is achieved. As an alternative to, or in addition to, using a porous material, the upper layer can be provided with apertures through which the air can flow to achieve the desired air release rate.

The tubes 30 are constructed so that, during use with air flow being provided to the manifold, the tubes 30 are expanded (as shown in FIG. 2). However, the tubes 30 are not intended to maintain their expanded shape when a person lays on the bed 13. Rather, portions of the tubes 30, upon sufficient force being applied thereto by a person situated on the bed 13, will collapse. Those tubes that are not collapsed will still have air flowing therein. Even the tubes that are collapsed may still have a small amount of air flow therein, depending upon the amount of blockage of the air flow passage 32 that occurs. As a person shifts position on the bed 13, tubes that were previously collapsed can open, while tubes that were previously open are collapsed. However, the number of tubes is such that the affects of the air flow through the tubes 30 is maintained. When air flow is not provided, the tubes 30 generally collapse upon themselves.

The lower layer 36 is preferably made of a material that has less porosity than the upper layer 34. Preferably, the majority of the air is released through the upper layer 34. However, it is preferred that a small amount of air also be released through the lower layer 36 toward the mattress surface in order to aid in killing mites in the mattress or other bedding disposed under the sheet 10. However, the lower layer 36 could be non-porous, in which case substantially all of the air would be released through the upper layer 34.

The tubes 30, as shown in FIG. 1, extend approximately halfway along the length of the sheet 10. In most circumstances, for an individual disposed on the bed 13, this length of the tubes 30 will ensure that the air flow from the tubes 30 will provide benefits to at least the upper half of the individual's body. To provide air flow to the lower regions of the individual's body, one or more of the tubes 30 can be extended down the length of the sheet 10 to adjacent the opposite end of the sheet. FIG. 1 shows tubes 30*a–d* that extend to the foot end of the sheet 10. By extending tubes in this manner, beneficial effects of the air flow can be provided to the lower regions of the person's body, including the feet. For example, the tubes 30*a–d* would allow heated air to be directed to the person's feet, thereby warming the feet.

As with the manifold 18, the air flow tubes can be separated into separate regions 40*a*, 40*b* of the sheet 10, with the tubes 30*a*, 30*b* in each region being fed with air from the separate manifolds 18*a*, 18*b*, as best seen in FIG. 5. The embodiment illustrated in FIG. 5 is particularly useful on larger sized mattresses, for example queen and king sizes, which accommodate more than one person. The air flow in each region 40*a*, 40*b* can be selected based on the desires of the person occupying the region. Further, the air flow tubes can be divided into top half and bottom half regions, each of which is fed with air separately to allow separate control of the air in those regions.

Those regions of the sheet 10 that do not contain the manifold 18 or the tubes 30 are formed from a single layer of material, as best seen in FIG. 2 which shows the side of the sheet 10 as a single layer of material. The material in these regions is preferably made from the same porous material as the upper layer 34 of the tubes 30.

Air flow to the sheet 10 is provided by an air delivery unit 42 that connects via a conduit 44 to the air inlet 26 of the sheet 10. For a sheet with a single manifold, as in FIG. 1, a single air delivery unit 42 can be used. For a sheet with multiple manifolds, as shown in FIG. 2, a plurality of air delivery units 42 can be used, each one being connected to a manifold.

The unit 42 includes a fan or blower assembly 46 (see FIG. 5) therein for creating the air flow. The air flow provided by the unit 42 needs to be sufficient to achieve the desired beneficial effects discussed in more detail below, yet be low enough to allow management of noise, comfort, and cost considerations. At this time, it is expected that an air flow rate in the range of about 5 to about 20 feet per minute as measured just above the surface of the sheet will be sufficient. As this air flow rate is measured above the surface of the sheet 10, it is to be realized that the air flow rate of the air delivery unit 42 needs to be selected to achieve this air flow rate above the sheet 10.

Because the sheet 10 is used in a sleep environment, noise considerations associated with the air delivery unit 42 need to be considered. At this point there is no specific noise level that is preferred. However, the noise generated by the unit 42 should be kept sufficiently low to avoid interference with sleep. A variety of factors and techniques are known to impact noise, including fan selection, the geometry of the housing enclosing the fan, baffling within the housing, venturis, acoustical foam, and the like. One or more of these should be kept in mind by a person having ordinary skill in the art.

The air delivery unit 42 is designed to deliver purified air to the sheet 10. To accomplish this, the unit 42 is preferably provided with a filtration mechanism 48, as shown in FIG.

5. The filtration mechanism 48 can be any filtration device that is capable of removing a high percentage of allergen particles from air passing therethrough. For example, the filtration mechanism 48 can be a HEPA filter, or an electrostatic precipitator. A HEPA filter is generally effective at removing up to 99.97% of particles having a size 0.3 microns or larger. Most allergen particles are over 5.0 microns in size, so a filter that is effective for these particle sizes could be used, with the realization that such a filter would be less efficient on smaller particles.

The air delivery unit 42 is also preferably capable of conditioning the air. Conditioning, as used herein, means affecting the air, other than filtration, in such a manner so as to provide a benefit to a person on the bed 13. Thus, the unit 42 can include a heater 50 (shown in FIG. 5), means for cooling the air, means for humidifying the air, means for introducing aromas and/or medicines into the air, and the like. A control panel 52 is preferably provided on the unit 42 to allow control of the air flow and conditioning affects that are provided. It is also contemplated that the unit 42 can be remotely controlled by a user using a remote controller (not shown).

A major benefit of providing the heater 50 is that heating the air will reduce the relative humidity of the air flow. Dust mites, which are a major source of allergen particles and which commonly reside on bedding sheets, require 50% relative humidity or more to survive on the sheet 10. By lowering the humidity of the air flow below this point, a less favorable environment for dust mites is created, thereby reducing the amount of allergens that are produced.

Optionally, the unit 42 can be constructed to perform a "mite kill" cycle. A "mite kill" cycle entails using the heater 50 to elevate the temperature of the air, and thus of the sheet 10 and possibly the surrounding bedding, to a temperature that is lethal to mites. This elevation is preferably accomplished over a relatively short period of time, when a person is not on the bed. By killing mites, the amount of allergen material that can be generated by the mites is reduced, thereby substantially reducing a major source of allergen material. The "mite kill" cycle is preferably initiated by pressing a suitable button on the unit 42. The unit 42 can also be designed to emit an audible sound during the "mite kill" cycle as a warning that the sheet 10 and surrounding bedding will be much warmer than usual. At this time, it is expected that the temperature will exceed 50° C.

By providing air flow to and through the sheet 10 a number of advantages can be realized. When purified air is delivered to the sheet 10 and subsequently out through the top of the tubes 30, the purified air is breathed by a person laying on top of the sheet 10. In general, a person's nose and mouth are disposed in relatively close proximity to the upper surface of the sheet 10 when sleeping. Thus, the purified air is breathed in with reduced chance of intermixing with surrounding room air which may contain undesirable allergen levels. Further, the flow of purified air from the tubes 30 creates a zone of purified air around the person. This zone can help reduce the level of allergens within the personal breathing zone or area of the person.

In addition, the air delivered to the sheet 10 can be conditioned, either separate from or in addition to being purified. Conditioning the air provides numerous added benefits. For example, heating the air will help warm a person who is on the bed 13. This heating occurs without exposing the person to potentially harmful electromotive force (EMF) created by the heating elements found in conventional electric blankets, with less chance of causing perspiration often associated with electric blankets, and at a constant temperature regardless of ambient temperature changes.

In particular, when the air flow tubes are extended down the length of the sheet towards the opposite end, the heated air will help warm the person's feet. In addition to providing warming benefits, the heated air is useful in controlling dust mites as discussed above. In contrast, cooling the air will help cool a person. The air flow through the sheet 10 may also be beneficial in controlling bed sores on a person confined to bed.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A system, comprising:

a sheet of pliable, washable, bedding-quality fabric material configured to fit over a mattress and cover the entire upper surface thereof, the sheet being greater in size that the upper surface of the mattress so that the sheet overhangs the edges of the mattress and the sheet can be tucked underneath the mattress, the portion of the sheet that in use covers the upper surface and a first portion of the sheet that overhangs one of the edges of the mattress consist of upper and lower fabric layers; and a manifold and a plurality of air flow tubes formed in the sheet, the manifold is formed between the upper and lower fabric layers of the first portion of the sheet so that the manifold overhangs the mattress edge, and the air flow tubes being formed by the upper and lower fabric layers with said air flow tubes in flow communication with said manifold, and the upper fabric layer that forms said air flow tubes forms an upper surface of the sheet that is constructed to release air at a controlled rate therethrough; and an air delivery unit connectable to the sheet to deliver air to said manifold.

2. The system according to claim 1, wherein said air delivery unit includes a blower.

3. The system according to claim 1, wherein said air delivery unit includes a heater for heating air.

4. The system according to claim 3, wherein said air delivery unit includes a mite kill cycle.

5. The system according to claim 1, wherein said air delivery unit includes a filtration mechanism.

6. A system, comprising:

a sheet of pliable, washable material configured to cover at least a portion of the upper surface of a mattress; and a manifold and a plurality of air flow tubes formed in the sheet, with said air flow tubes in flow communication with said manifold, and said air flow tubes include top surfaces that are constructed to release air at a controlled rate therethrough;

an air delivery unit connectable to the sheet to deliver air to said manifold, said air delivery unit includes a heater for heating air and includes a mite kill cycle and during a mite kill cycle the air delivery unit delivers heated air to the sheet at a temperature sufficient to kill mites in the sheet.

7. A system for delivering conditioned air to a persons breathing zone, comprising:

a device for distributing conditioned air adjacent the person's breathing zone while the person is disposed on an item of furniture, the device having at least one air flow passage defined therein to allow flow of conditioned air within the device, and the device having at least one surface that is in flow communication with the flow passage and that is constructed to release conditioned air at a controlled rate therethrough; and the device is configured to cooperate with the item of furniture so that the conditioned air released through the surface is directed toward the individual disposed on the item of furniture; and an air delivery unit connectable to the device to deliver conditioned air to the air flow passage, said air delivery unit includes a heater for heating air and includes a mite kill cycle and during a mite kill cycle the air delivery unit delivers heated air to the device at a temperature sufficient to kill mites in the device.

8. A method of improving the air qualify in a personal breathing environment of an individual occupying a piece of furniture, comprising:

providing a device for distributing conditioned air, the device having at least one air flow passage defined therein to allow flow of conditioned air within the device, and the device having at least one surface that is in flow communication with the flow passage and that is constructed to release conditioned air at a controlled rate therethrough;

arranging the device relative to an individual occupying an item of furniture so that conditioned air released through the surface is directed toward an area around the individual's head and into the individual's breathing environment when the individual is occupying the item of furniture;

delivering conditioned air to the air flow passage in the device whereby some of the conditioned air is directed into the personal breathing environment of the individual; and delivering heated air to the device for distributing conditioned air at a temperature sufficient to kill mites in the device for distributing conditioned air.

9. A system, comprising:

a mattress having a plurality of air flow tubes positioned at or near a top of the mattress, each air flow tube being defined by a top surface of air-permeable fabric and a bottom surface of air-permeable fabric, the air-permeable fabric of the top surface and the air-permeable fabric of the bottom surface permitting the flow of air therethrough at a controlled rate;

a manifold adjacent the top of the mattress and overhanging an edge thereof, the manifold in flow communication with the air flow tubes to deliver air to the air flow tubes; and an air delivery unit connectable to the manifold for delivering air to the manifold, the air delivery unit including a heater that heats the air that is delivered to the manifold.

10. The system of claim 9, wherein the heater heats the delivered air to a temperature sufficient to kill mites in the sheet as a result of the heated air being delivered to the sheet.

11. The system of claim 9, wherein the heater heats the delivered air to a temperature exceeding 50° C. to kill mites in the sheet as a result of the heated air being delivered to the sheet.

12. The system of claim 9, wherein the air flow tubes and the manifold are part of a bedding sheet disposed on the mattress, and the manifold is formed between upper and lower layers of fabric.

* * * * *